US006644539B2

(12) United States Patent
Boyd et al.

(10) Patent No.: US 6,644,539 B2
(45) Date of Patent: Nov. 11, 2003

(54) PACKAGE WITH BOTTOM PANEL STAND-OFFS

(75) Inventors: Craig Boyd, Arlington Heights, IL (US); Charles Christensen, Hudson, WI (US)

(73) Assignee: Tetra Laval Holdings & Finance, SA, Pully (CH)

( * ) Notice: Subject to any disclaimer, the term of this patent is extended or adjusted under 35 U.S.C. 154(b) by 105 days.

(21) Appl. No.: 09/976,702

(22) Filed: Oct. 12, 2001

(65) Prior Publication Data

US 2003/0071113 A1 Apr. 17, 2003

(51) Int. Cl.[7] ..... B65D 5/44

(52) U.S. Cl. ..... 229/104; 229/125.42; 229/184; 493/133; 493/183

(58) Field of Search ..... 229/104, 125.42, 229/137, 184; 493/133, 164, 183

(56) References Cited

U.S. PATENT DOCUMENTS

| | | | | | |
|---|---|---|---|---|---|
| 1,964,305 | A | | 6/1934 | Troyk | |
| 2,070,747 | A | * | 2/1937 | Orstrom | 229/104 |
| 2,232,088 | A | * | 2/1941 | Waters | 229/104 |
| 2,312,595 | A | | 10/1943 | Smith | |
| 3,004,696 | A | * | 10/1961 | McCormick | 229/104 |
| 3,051,368 | A | | 8/1962 | Schneider et al. | |
| 3,259,296 | A | | 7/1966 | Beranger | |
| 3,586,232 | A | * | 6/1971 | Scully | 229/104 |
| 3,727,783 | A | | 4/1973 | Carmichael | |
| 3,759,410 | A | | 9/1973 | Uhlig | |
| D240,019 | S | | 5/1976 | Taylor | |
| 4,175,670 | A | | 11/1979 | Reynolds et al. | |
| 4,717,069 | A | * | 1/1988 | Pizzolato | 229/104 |
| 4,838,847 | A | * | 6/1989 | Kume et al. | 493/164 |
| 4,867,323 | A | | 9/1989 | Powers | |
| 5,056,707 | A | * | 10/1991 | Larsen | 229/137 |
| 5,289,943 | A | * | 3/1994 | Powell | 229/104 |
| 5,295,941 | A | * | 3/1994 | Fujikawa et al. | 493/133 |
| RE35,140 | E | | 1/1996 | Powers, Jr. | |
| 5,845,840 | A | * | 12/1998 | Johansson et al. | 229/125.42 |
| 5,988,490 | A | * | 11/1999 | Christensen | 229/184 |
| 6,027,015 | A | | 2/2000 | Christensen | |
| D426,559 | S | | 6/2000 | Christensen et al. | |
| 6,094,884 | A | | 8/2000 | Christensen et al. | |
| D440,466 | S | | 4/2001 | Lillelund et al. | |

FOREIGN PATENT DOCUMENTS

| | | |
|---|---|---|
| WO | WO 9856570 A1 | 5/1999 |

* cited by examiner

*Primary Examiner*—Gary E. Elkins
(74) *Attorney, Agent, or Firm*—Welsh & Katz, Ltd.

(57) ABSTRACT

A package with bottom panel stand-offs includes a plurality of upstanding side walls, each side wall contiguous or sealed to adjacent side walls, a sealed top panel, and a sealed bottom panel. The sealed bottom panel has a generally planar portion and three stand-offs formed therein. The three stand-offs are non-coplanar with the generally planar region and define a triangular pattern other than a right angle triangle. The stand-offs raise the generally planar portion above and spaced from a surface on which the package rests. A method for forming a stable carton is also disclosed.

16 Claims, 1 Drawing Sheet

PACKAGE WITH BOTTOM PANEL STAND-OFFS

BACKGROUND OF THE INVENTION

The present invention is directed to a package having bottom panel stand-offs. More specifically, the present invention is directed to a package having a plurality of stand-offs or raised portions on the bottom to enhance package stability.

Packages having non-planar bottom walls are known in the art. For example, U.S. Pat. No. 6,027,015 discloses a package having an elevated bottom in which the center portion of the carton bottom wall is elevated from the surface on which the package rests. The package prevents liquids from wicking into the package material along the bottom wall at the raw material edges. Such a package design has proven quite effective for eliminating "soggy" package bottoms.

In addition to eliminating wet or soggy package bottoms, it has been found that a secondary benefit of such packages is to enhance the stability of the package. That is, when resting on a grocer's shelf or dairy case shelf, packages are less likely to lean to one side as a result of a non-planar bottom wall surface. It has been found that the enhanced package stability provides for a much "neater" look in merchandising.

The wide scale acceptance of gable top packaging for foods, generally, is among food packagers and consumers alike. As such, increasing numbers of dry food products are being packaged in these gable top packages. For example, dried soups, snacks and crackers are becoming more popular in these packages. As such, there is an increased desire to improve the aesthetics of these packages for the dry food industry.

Attempts have been made to incorporate the lessons learned or experience of the liquid food packaging industry into the dry foods arena. While much of this experience has been incorporated into dry food packaging, certain types of foods have not fully conformed to these experiences. For example, it has been found that lower density (e.g., lighter) foods have a lesser effect on conforming a package to a square or rectangular shape, than do liquid foods. That is, liquids packaged in these cartons exert forces on the packaging the tend to maintain overcome a slightly off-square or rectangular shape that the package may exhibit as a result of the forming, filling and sealing operation.

Generally, cartons will tend to return to their stored state. In that the cartons are stored in the side-sealed blank form (that is with the side seal formed and in a flat state), the cartons' natural tendency is to return to this off-rectangular or off-square shape, even after forming, filling and top sealing. This is referred to as "spring-back". Spring-back is generally dependent upon material type and creasing.

Although the forces exerted by higher density product (e.g., liquid foods) better overcome the spring-back effect, less dense product may not. This is true even if the top sealing operation is fully within alignment specifications. As a result, the packages may be unstable and can lean or tilt when merchandised, e.g., on a grocer's shelf. It has also been found that, while the elevated carton bottom configuration disclosed in the above-noted U.S. Pat. No. 6,027,015 does, in fact, assist in maintaining the squared configuration of the carton, it may not fully do so.

Accordingly, there exists a need for a carton configuration that provides enhanced stability to the carton. Desirably, such a carton functions well with low density (light) food stuffs. Most desirably, such a carton can be manufactured from standard food packaging materials, without the need for carton blank redesign and with minimal changes to the forming, filling and sealing machines.

BRIEF SUMMARY OF THE INVENTION

A package with bottom panel stand-offs includes a plurality of upstanding side walls, each side wall contiguous or sealed to adjacent side wall, a sealed top panel and a sealed bottom panel. The sealed bottom panel has a generally planar portion and three stand-offs formed therein. The three stand-offs are non-coplanar with the generally planar region and define a triangular pattern other than a right angle triangle.

The stand-offs raise the generally planar portion above and spaced from a surface on which the package rests. The package exhibits enhanced stability and functions well with low density (light) food stuffs. The package can be manufactured from standard food packaging materials, without the need for package or carton blank redesign and with minimal changes to the forming, filling and sealing machines.

In one embodiment, one of the stand-offs lies on a bottom panel seal. Alternately, none of the stand-offs lie on the bottom panel seal. A contemplated package is a gable top carton. The stand-offs enhance stability in cartons that otherwise tend to "spring-back."

The stand-offs have a generally rectangular shape. Preferably, the stand-offs are square. First and second stand-offs are formed at first and second adjacent comers of the bottom panel. A third stand-off is formed at about a midpoint of a side opposite of the first and second stand-offs. The triangular pattern formed by the stand-offs is an isosceles triangular pattern. The triangular pattern can be such that a line dividing the triangular pattern defines two back to back, mirror image right triangles.

A bottom forming plate for forming a sealed bottom panel in a carton having bottom panel stand-offs includes a generally planar portion and first, second and third outwardly extending stand-off forming elements. The elements define a triangular pattern other than a right angle triangle. The stand-offs define a plane that is non-coplanar with the generally planar portion.

When the plate is pressed against a carton bottom panel, the first and second stand-off forming elements form first and second and second stand-offs at adjacent comers of the bottom panel and the third stand-off forming element forms a third stand-off at about a midpoint of a side of the carton bottom opposite of the first and second stand-offs. The stand-offs so formed raise the carton bottom above and spaced from a surface on which the package rests.

The stand-off forming elements can have a generally rectangular shape. Preferably, they are square. Most preferably, the plate is formed as a mandrel cap.

A method for forming a stable package includes the steps of forming a carton having four upstanding side walls, each side wall contiguous with or sealed to adjacent side walls and a having a sealed bottom wall. The sealed bottom wall is formed having a generally planar portion. The method further includes forming three and only three bottom panel stand-offs, the stand-offs being first, second and third generally rectangular stand-offs formed in the bottom panel. The stand-offs are formed non-coplanar with the generally planar region and define a triangular pattern other than a right angle triangle.

In forming the stand-offs, the first and second stand-offs are formed at first and second adjacent comers of the bottom panel and the third stand-off is formed at about a midpoint of a side opposite of the first and second stand-offs. The stand-offs raise the generally planar portion above and spaced from a surface on which the package rests.

The method includes filling the carton and sealing a top panel to form a gable.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
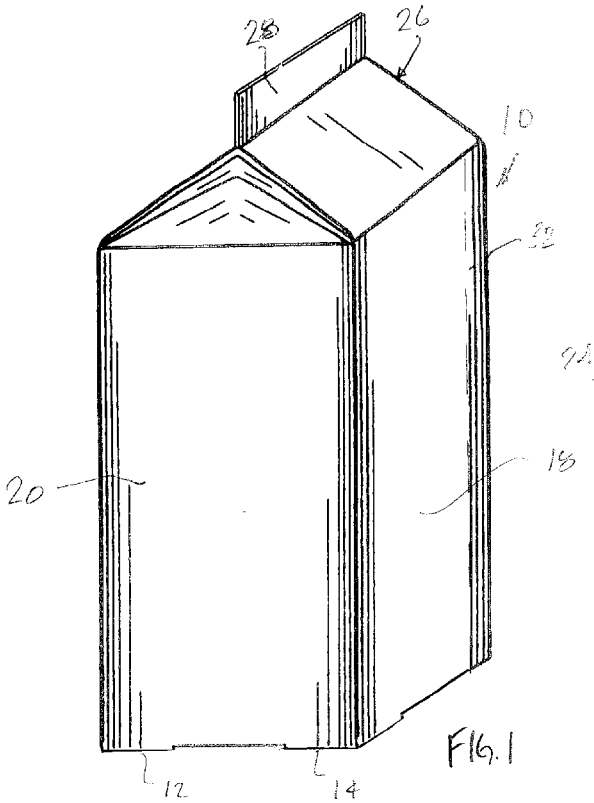
FIG. 1 illustrates a perspective view of a carton having bottom panel stand-offs embodying the principles of the present invention.
Figure 2:
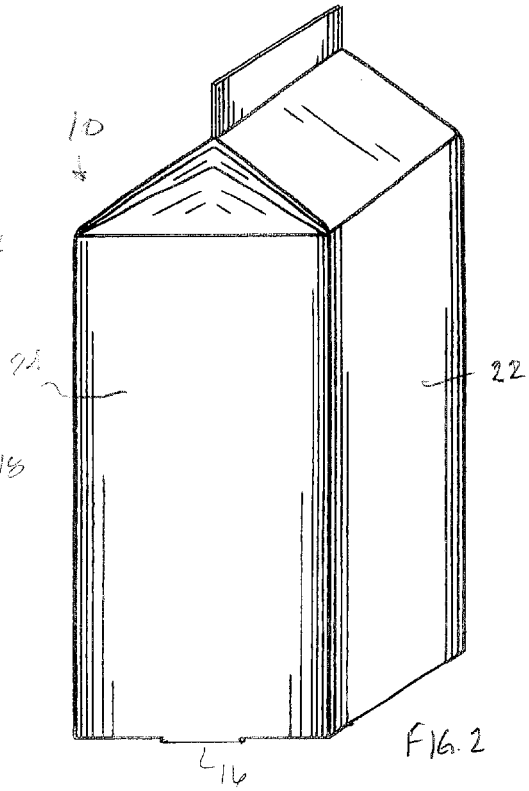
FIG. 2 is an opposing perspective view of the carton of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Referring now to the figures and in particular FIG. 1, there is shown a carton 10 having bottom panel stand-offs 12, 14, 16 embodying the principles of the present invention. The carton 10 generally includes a plurality of side panels 18, 20, 22, 24, top panels formed as a gable 26 and including a sealed top fin 28, and a sealed bottom wall or panel 30. A sealing panel 32 connects side panels 18 and 24 into the well recognized contiguous, tubular form. The bottom wall 30 of the container 10 can be configured, generally, as illustrated and described in the above-noted patent to Christensen, without the elevated bottom portion as disclosed in that patent.

Figure 3:
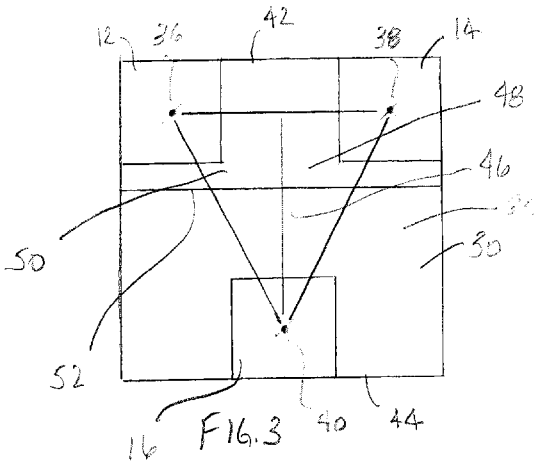
FIG. 3 is a bottom view of the carton of FIGS. 1 and 2.

Referring now to FIG. 3, it can be seen that the present carton 10 includes a plurality of bottom stand-offs 12, 14, 16 extending outwardly or downwardly from a planar portion 35 that extends between the stand-offs 12, 14, 16. Specifically, the carton 10 includes three bottom stand-offs that essentially define a non-right angle triangular pattern (as indicated at 34), between the respective centers 36, 38, 40 of the stand-offs 12, 14, 16. In this configuration, none the stand-offs 12, 14, 16 lie on or along the bottom panel seal 52.

Preferably the triangular pattern 34 is an isosceles triangular pattern. As seen in FIG. 3, two of the three stand-offs 12, 14 lie along one side 42 of the bottom panel 30 at opposing, adjacent corners. On the opposing side 44 of the bottom panel 30, a single stand-off 16 is located about mid-way along the side 44. In this manner, the triangle 34 formed from lines drawn between the centers 36, 38, 40 of the stand-offs 12, 14, 16 define a single isosceles triangle which, when divided, as indicated by the line at 46, defines two back to back, mirror image right triangles 48, 50.

It has been found that this configuration of stand-offs 12, 14, 16 provides superior stability characteristics to the package 10. Essentially, it has been found that the triangular pattern 34, and particularly the isosceles triangular pattern extending out to the ends of the bottom panel 30 (that is, to the junctures of the bottom panel 30 and the side walls 18, 20, 22 and 24) provides exceptional carton 10 stability. As such, even with extremely low density food stuffs, the present package 10 is stable and generally overcomes the "spring-back" effect. That is the carton 10 does not rock when resting on a grocer's or merchandiser's shelf, or a consumer's table.

Surprisingly, it has been found that even with cartons 10 that have a tendency to spring-back, or even if the carton gable 26 (that is, the top fin 28 seal) is not exactly aligned, the present package 10 will maintain its stability even with these low density foods. As will be recognized by those skilled in the art, when cartons exhibit the "spring-back" tendency, the effect can be transferred to the overall shape of the carton 10, and ultimately to the bottom panel or wall 30. When transferred to the bottom panel 30, an out-of-square or out-of-rectangle shape can occur. This can result in instability and rocking. It has been found that the stand-offs 12, 14, 16 overcome any rocking or instability that may result from this out-of-square or out-of-rectangle shape.

It has also been found that these packages 10 are not only stable when filled with low density food stuffs, but, they maintain an essentially full upright orientation when resting on the merchandiser's shelf.

Figure 4:
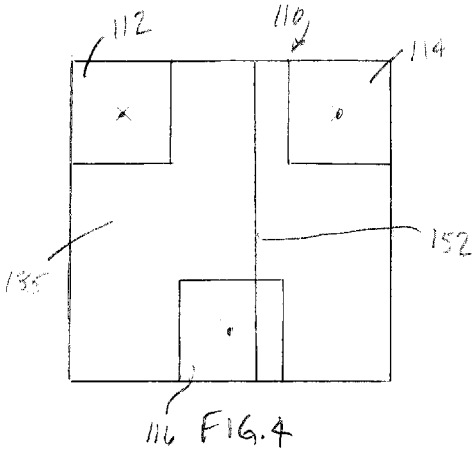
FIG. 4 is a bottom view of an alternate embodiment of a carton having the bottom panel stand-offs.

Referring now to FIG. 4, there is shown an embodiment 110 in which one of the stand-offs 116 is positioned along the carton bottom seal as indicated at 152. The other stand-offs 112, 114 do not lie along the seal 152. Nevertheless, in this embodiment 110, the same relationship and advantages vis-à-vis stability and upright form result.

Figure 5:
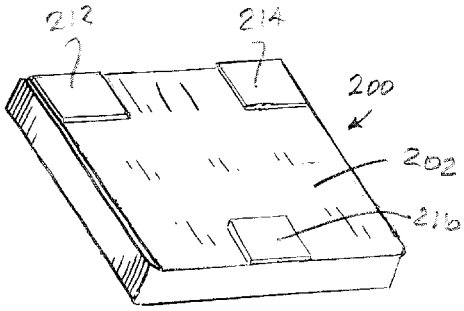
FIG. 5 is a perspective view of an exemplary bottom forming plate for forming the carton having bottom stand-offs.

Referring now to FIG. 5, there is shown an exemplary bottom forming plate, which can be provided as a mandrel cap 200, that can be used for forming the stand-offs 12–16, 112–116. The mandrel cap 200 includes a generally planar central portion 202 and a plurality of elevated stand-off forming portions 212, 214, 216. The mandrel cap 200 is used on a mandrel for forming the carton bottom, in a form, fill and seal packaging machine, such as that illustrated and described in Giacomelli et al., U.S. Pat. No. 5,819,504, commonly assigned herewith and incorporated herein by reference.

The relationship, i.e., formation of a triangle between the centers, between the stand-off forming portions 212–216 is that as described above with respect to the stand-offs 12–16.

A method for forming a stable package 10, 110 includes forming a carton having four upstanding side walls 18, 20, 22, 24, with each side wall being contiguous with or sealed to adjacent side walls. The carton 10, 110 is formed having a sealed bottom wall 30, 130 that has or defines a generally planar portion 35, 135.

Three and only three bottom panel stand-offs 12, 14, 16 (112, 114, 116) are formed in the carton 10, 110. In a conventional form, fill and seal operation, the stand-offs 12, 14, 16 (112, 114, 116) are formed in the bottom wall 30, 130 when the bottom wall panels are folded onto each other and sealed. At the time of seal formation, the forming plate 200 is pressed against the heated and folded panels, thus forming the bottom wall seal 52, 152 and the stand-offs 12, 14, 16 (112, 114, 116).

The stand-offs so formed are first, second and third generally rectangular stand-offs. The stand-offs 12, 14, 16 (112, 114, 116) are non-coplanar with the generally planar region 35, 135 and define a triangular pattern 34 other than a right angle triangle. The first and second stand-offs 12, 14 (112, 114) are formed at first and second adjacent corners of the bottom panel and the third stand-off 16 (116) is formed at about a midpoint of a side opposite of the first and second stand-offs. The stand-offs 12, 14, 16 (112, 114, 116) raise the generally planar portion 35, 135 above and spaced from a surface on which the package 10, 110 rests.

The carton 10, 110 is then filled and a top sealed is formed as a gable. In one embodiment the method includes the step of forming one of the stand-offs on a bottom panel seal 152. Alternately, the method includes forming the stand-offs such that none of the stand-offs lie on a bottom panel seal 52.

In a preferred method the stand-offs 12, 14, 16 (112, 114, 116) are formed having a generally square shape. In a most preferred method the triangular pattern 34 is an isosceles triangular pattern, and a line 46 dividing the triangular pattern 34 defines two back to back, mirror image right triangles 48, 50.

The disclosure of each patent cited herein, whether or not done so specifically, is incorporated herein by reference.

From the foregoing it will be observed that numerous modifications and variations can be effectuated without departing from the true spirit and scope of the level concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A package with bottom panel stand-offs comprising:

four upstanding side walls, each side wall contiguous with or sealed to adjacent side walls;

a sealed top panel formed as a gable; and a sealed bottom panel, the sealed bottom panel having a generally planar portion and only three stand-offs, the stand-offs being first, second and third generally rectangular stand-offs formed in the bottom panel, the stand-offs being non-coplanar with the generally planar region and defining a triangular pattern other than a right angle triangle, the first and second stand-offs being formed at first and second adjacent corners of the bottom panel and the third stand-off being formed at about a midpoint of a side opposite of the first and second stand-offs, wherein the stand-offs raise the generally planar portion above and spaced from a surface on which the package rests.

2. The package in accordance with claim 1 wherein one of the stand-offs lies on a bottom panel seal.

3. The package in accordance with claim 1 wherein none of the stand-offs lie on a bottom panel seal.

4. The package in accordance with claim 1 wherein the stand-offs have a generally square shape.

5. The package in accordance with claim 1 wherein the triangular pattern is an isosceles triangular pattern.

6. The package in accordance with claim 1 wherein a line dividing the triangular pattern defines two back to back, mirror image right triangles.

7. A bottom forming plate for forming a sealed bottom panel in a carton having bottom panel stand-offs, comprising:

a generally planar portion; and first, second and third outwardly extending stand-off forming elements defining a triangular pattern other than a right angle triangle, the stand-offs defining a plane non-coplanar with the generally planar portion, wherein when the plate is pressed against a carton bottom panel, the first and second stand-off forming elements form first and second and second stand-offs at adjacent corners of the bottom panel and the third stand-off forming element forms a third stand-off at about a midpoint of a side of the carton bottom opposite of the first and second stand-offs, such that the stand-offs raise the carton bottom above and spaced from a surface on which the package rests.

8. The bottom forming plate in accordance with claim 7 wherein the first, second and third stand-off forming elements have a generally rectangular shape.

9. The bottom forming plate in accordance with claim 8 wherein the first, second and third stand-off forming elements have a generally square shape.

10. The bottom forming plate in accordance with claim 7 wherein the plate is formed as a mandrel cap.

11. A method for forming a stable package comprising:

forming a carton having four upstanding side walls, each side wall contiguous with or sealed to adjacent side walls and a having a sealed bottom wall, the sealed bottom wall being formed having a generally planar portion;

forming three and only three bottom panel stand-offs, the stand-offs being first, second and third generally rectangular stand-offs formed in the bottom panel, the stand-offs being non-coplanar with the generally planar region and defining a triangular pattern other than a right angle triangle, the first and second stand-offs being formed at first and second adjacent corners of the bottom panel and the third stand-off being formed at about a midpoint of a side opposite of the first and second stand-offs, the stand-offs raising the generally planar portion above and spaced from a surface on which the package rests;

filling the carton; and sealing a top panel formed as a gable.

12. The method in accordance with claim 11 including the step of forming one of the stand-offs on a bottom panel seal.

13. The method in accordance with claim 11 wherein none of the stand-offs are formed to lie on a bottom panel seal.

14. The method in accordance with claim 11 including the step of forming the stand-offs to have a generally square shape.

15. The method in accordance with claim 11 wherein the triangular pattern is an isosceles triangular pattern.

16. The method in accordance with claim 11 including forming the stand-offs such that a line dividing the triangular pattern defines two back to back, mirror image right triangles.

* * * * *